US006199531B1

(12) United States Patent
Daniels

(10) Patent No.: US 6,199,531 B1
(45) Date of Patent: Mar. 13, 2001

(54) SHUTTER VALVE SYSTEM FOR INTERNAL COMBUSTION ENGINES

(76) Inventor: Kyle P. Daniels, 601 SW. 24 Rd., Miami, FL (US) 33129

( * ) Notice: Subject to any disclaimer, the term of this patent is extended or adjusted under 35 U.S.C. 154(b) by 0 days.

(21) Appl. No.: 09/425,900

(22) Filed: Oct. 25, 1999

(51) Int. Cl.[7] ..... F02N 3/00

(52) U.S. Cl. ..... 123/188.1; 123/190.1; 123/190.8

(58) Field of Search ..... 123/188.1, 190.1, 123/190.8

(56) References Cited

U.S. PATENT DOCUMENTS 1,002,756 * 9/1911 Reynolds ..... 123/190.1

* cited by examiner

*Primary Examiner*—Noah P. Kamen
(74) *Attorney, Agent, or Firm*—Malloy & Malloy, P.A.

(57) ABSTRACT

A valve system designed for use in an internal combustion engine to regulate the flow of working fluids including air/fuel mixtures and exhaust gases to and from a cylinder comprising an intake valve and an exhaust valve. At least one but preferably both of the intake and exhaust valves comprise a shutter valve, defined by a plurality of valve elements in the form of partially overlapping valve blades slidable relative to one another and defining a central aperture having an adjustable dimension dependent upon the relative positioning of the plurality of valve elements as they are selectively oriented between an open position and a closed position. The central aperture at least partially defines a free, unobstructed flow path of fluid passing into or out of the combustion chamber before and after the ignition of the air/fuel mixture. A control assembly comprises a plurality of sensors each transferring sensor signals to a central processing unit for purposes of indicating the operating characteristics of the internal combustion engine. The central processing unit is interconnected by an activation assembly to the intake and exhaust shutter valve so as to regulate operation thereof based on the operational conditions of the internal combustion.

20 Claims, 4 Drawing Sheets

SHUTTER VALVE SYSTEM FOR INTERNAL COMBUSTION ENGINES

BACKGROUND OF THE INVENTION

1. Field of the Invention

The present invention is directed to a valve system for use in regulating fluid flow into and out of a combustion cylinder of the type housing a reciprocating piston. More in particular, the intake and exhaust valves associated with the valve system of the present invention are a folding leaf or folding blade type of shutter valve wherein a central aperture is formed when the valves are disposed in an open position for the substantially free, unobstructed passage of fluid flow therethrough. Further, the shutter valves associated with the present invention are computer and/or electronically controlled based on the operating performance and characteristics of the internal combustion engine.

2. Description of the Related Art

Automobiles, boats, airplanes, and other types of motorized vehicles are typically powered by internal combustion engines which are designed to provide energy through a flywheel which is turned by a crank shaft. In the operation of an internal combustion ("I.C.") engine, a combustible air/fuel mixture is drawn inside a cylinder with the combustion taking place in the combustion chamber located at the top of each cylinder. In each cylinder, a piston, which is connected to the crank shaft through a connecting rod, continuously reciprocates during operation of the I.C. engine. The reciprocation of the piston moving up and down powers the crank shaft. The cyclical movement in an automobile engine is typically termed a "four stroke cycle". The four strokes of the four stroke cycle are named according to their respective purpose and include an intake stroke, a compression stroke, a power stroke and an exhaust stroke. In order to maximize the conversion of energy produced from the combustion of fuel into mechanical energy, by the piston turning the crank shaft, combustion occurs within the top of the cylinder, wherein the combustion chamber is effectively sealed during combustion.

The intake and exhaust of gases from an internal combustion engine are controlled by intake and exhaust valves respectively, disposed in fluid communication within the combustion chamber. Accordingly, the cylinder head has an intake opening and an exhaust opening for allowing an air/fuel mixture to enter the cylinder and for exhaust to exit the cylinder after ignition and combustion of the air/fuel mixture. In order to maintain the cylinder in a fluid-tight or sealed condition during the compression and power strokes, valves in the cylinder head close the intake and exhaust openings. These valves are accordingly referred to as the intake and exhaust valves.

The intake and exhaust valves operate at different times depending on the cycle of the engine. These valves are normally held closed by heavy springs and increased pressure due to compression within the cylinder. The purpose of a valve actuating mechanism is to overcome the spring pressure and open the valves at the proper time. The valve actuating mechanism includes the engine cam shaft, cam shaft borrowers or tappets, push rods and rocker arms. The cam shaft, which rotates to drive the individual poppet valves, is generally enclosed within the engine block or cylinder head. The cam shaft has eccentric lobes or cams formed thereon such that each of the cams are specifically disposed and configured for predetermined driving engagement with each valve in the engine. As the cam shaft rotates, the cam lobes move up under the valve tappet, thereby exhibiting an upward thrust through the tappet against the valve stem or push rod. This thrust overcomes a valve spring pressure as well as increased pressure within the cylinder and causes the valve to open. When the lobe moves under the tappet, the valve spring reseats the valve resulting in a closing of the valve opening.

During the intake stroke of a four stroke cycle, the intake valve is opened and the exhaust valve is closed, allowing the air/fuel mixture to fill the cylinder. In the compression stroke of the four stroke cycle, both the intake and exhaust valves are closed. In the power stroke, both the intake and exhaust valves are closed and a spark generated by the spark plug located inside the cylinder and in direct communication with the combustion chamber serves to ignite the air/fuel mixture causing its combustion and forcing the piston in a downward direction towards the bottom of the cylinder. In the exhaust stroke of the four cycle engine, the piston travels upward from the crank shaft and the exhaust valve is opened while the intake valve is closed. The upwardly traveling piston forces the exiting of all the exhaust gases from the cylinder. The exhaust gases are a result of the combustion of the air fuel mixture during the previous power stroke. The exhaust gases exit the cylinder head through the exhaust manifold. The four stroke cycle is then repeated numerous times in rapid succession for the powering of the crank shaft.

The duration of the opening and closing of the intake and exhaust valves is fixed, depending on the configuration of the cam lobe which lifts the valve tappets, and accordingly, opens the intake and exhaust valves. The fixed period of time during which the intake and exhaust valves are open is only optimal for one particular revolution per minute (RPM) of the crank shaft. This is generally preset at around 3500 RPMs. However, the amount of the air/fuel mixture, and consequently, exhaust gases, vary depending on the particular RPMs at which the vehicle is operating. The optimal air to fuel ratio is typically recognized as 14.7 parts of air to 1 part fuel. Accordingly, as more fuel is required at higher RPMs, a considerable volume of fuel and air is required to pass through the intake valve. Also, at lower RPMs a relatively small volume of air and fuel is required to pass through the intake valve. However, because the intake valve remains open for a fixed period of time, the air/fuel mixture has a tendency to blow out of the cylinder and pass back into the intake manifold. This phenomenon is known as "blow back". Therefore, with a pre-defined duration for the valve opening, the intake and exhaust valves frequently stay open too long or not long enough depending upon the RPMs of the engine.

An additional problem associated with the use of poppet valves for the intake and exhaust valves is that they require cavities to be formed within the cylinder head creating a dimpled interior within the combustion chamber. Accordingly, when the spark plug generates the spark used to ignite the air fuel mixture, there frequently exists an uneven flame propagation and some of the air fuel mixture does not combust. Further, the combustion of the air/fuel mixture results in energy which is directed into the valve cavities and away from the piston. Both of these situations result in an inefficient combustion and a loss of energy from the ignition of the air/fuel mixture within the interior of the combustion chamber.

In the simplest terms, the purpose of the intake and exhaust valves associated with internal combustion ("I.C.") engines of the type set forth above, is to regulate the flow of gases at the proper intervals into and out of the cylinders of the I.C. engines. The mechanisms responsible for setting the working fluids of an engine in motion are the reciprocating parts, which are more commonly known as the "bottom end". The "bottom end" includes the crank shaft, connecting rods and pistons of an I.C. engine, as generally set forth above. These parts are attached to one another in a manner which converts linear motion into rotational motion for the powering of the crank shaft. When the "bottom end" is in motion, it pulls and pushes working fluid past the valves by creating vacuum and pressure within the cylinders. The vast majority of reciprocating piston I.C. engines use poppet valves which effectively obstruct and are, therefore, restrictive to fluid flow.

The use of poppet valves in reciprocating, I.C. combustion engines dates back over a hundred years. They have long been recognized as the most popular valve design for intake and exhaust valves of reciprocating I.C. engines. However, as set forth above, these valves are restrictive to the passage of the working fluid and their use results in a strain being placed on the "bottom end" as it fights the resistance from the fluid passing over the valve. Therefore, undesirable behavior of the working fluid occurs because of the restriction or obstruction placed on fluid flow by the poppet valves as the fluid enters the cylinders. With high lift applications, more room is given to the working fluid, and the performance of the working fluid improves, as can be observed mathematically through calculations of efficiency and power. In addition, poppet valves typically cause the fuel/air mixture to "sprinkler" out into a 360 degree spray having a thickness dependent upon the degree of valve lift. This type of mixture manipulation is not ideal for filling a cylinder quickly and efficiently. Poppet valves also require a heavy valve train, take up valuable space beneath the hood of a vehicle and consume more energy during their operation than would otherwise be desirable. Accordingly, it is easily recognized that despite their extensive and long term use, poppet valves are not the most efficient means of regulating fluid flow through the intake and exhaust force of an engine.

Therefore, there is a need in the design and operation of reciprocating, internal combustion engines, as well as a variety of other applications, for a valve system comprising intake and exhaust valves for regulating fluid flow to and from a cylinder, which operates more efficiently than conventional valve systems. If any such improved valve system were developed, it would preferably not use the crankshaft for the forced movement of the intake and exhaust valves between an open and closed position so as to increase overall engine efficiency, and more importantly, allow a greater percentage of the created power to be delivered to the flywheel. Further, as less weight and space would be desirable so as to achieve a more efficient operation, any such improved valve system would improve the aerodynamics and fuel efficiency of a vehicle by reducing the space required in the design of the hood and engine cavity portions of a vehicle, as well as reducing the overall weight associated with the components used to typically drive conventional valve systems.

SUMMARY OF THE INVENTION

The present invention is intended to address many of the known problems which remain in the art and is directed towards a valve system of the type used for reciprocating internal combustion ("I.C.") engines including a valve assembly associated with each cylinder of the I.C. engine, and further, wherein the valve assembly includes at least an intake valve and an exhaust valve for directing working fluid (i.e., an air/fuel mixture and exhaust gases) into and out of the cylinder. More specifically, the valve system of the present invention is preferably, but not necessarily, electronically controlled through the use of a computer microchip or other central processing unit ("CPU") programmed and otherwise structured to provide greater overall engine efficiency through the elimination of the use of the crankshaft to drive the valve system.

In addition, the valve system of the present invention preferably comprises a control assembly which, in addition to the computer microchip or CPU, also includes a plurality of sensors structured and disposed to monitor various operating or performance characteristics of the engine, or vehicle in which it is mounted, during the operation thereof. Operating or performances characteristics to be monitored include, but are not necessarily limited to, engine speed, crankshaft position, gear position, throttle position, air mass, intake manifold pressure and temperature, clutch position, air/water temperature, fuel level and pressure. The plurality of sensors included as part of the control assembly generate signals back to the central processing unit (CPU) which are indicative of the most current operating/performance characteristics during the operation of the motor and/or vehicle. In turn, the central processor is designed and structured to generate activating signals to an activation assembly which, as will be described in greater detail hereinafter, continuously regulates the operation, including timing and positioning, of the individual valves of the valve assembly associated with each cylinder of the I.C. engine.

One feature of the present invention is the design and structure of at least specific ones, but preferably all of the valves of the valve assembly, to comprise what shall be referred to herein as "shutter" valves. Before detailing the operative and structural components and features of the "shutter valve"referred to herein, it is important to emphasize the operational characteristics of a working fluid such as an air/fuel mixture, particularly as it is directed into the cylinder of a reciprocating I.C. engine. More specifically, a working fluid, when travelling through a conduit or tubing at a high rate of speed includes a certain momentum. To accomplish maximum efficiency in the workings and operation of an improved valve system, such momentum should be disturbed as little as possible during the flow of the working fluid and its delivery into the cylinder. However, and as has been referred to previously herein, the conventional use of poppet valves in reciprocating I.C. engines creates a disturbance of the momentum of the working fluid by providing a direct obstruction in the path of fluid flow, and specifically, at the point where the air/fuel mixture passes into the cylinder during the intake stroke of a four cycle engine.

Accordingly, to better realize the full potential of an engine and maximize its efficiency, it is necessary to provide a substantially unobstructed, free flow valve system which does not disturb the inherent momentum of fluid flow by providing an obstruction along the length of the flow path or at the point of delivery. It is thought by the inventor hereof that an optimal way to facilitate the flow of a working fluid in the form of a jet stream (air/fuel mixture or exhaust gases) is to provide, along the path of fluid flow, and particularly at the point of delivery, an aperture having a diameter or overall dimension slightly larger than the diameter or corresponding dimension of the "jet stream" defining the fluid flow. By way of example, this principle may be demonstrated by observing the workings of a tornado, wherein the rotational velocity of the jet stream is directly related to the circumference of that jet stream. More particularly, rotational velocity increases as the circumference of a stream decreases. Accordingly, it is thought by the inventor hereof that a swirling flow of working fluid can offer a more concentrated air fuel mixture being introduced into the cylinder. While this phenomenon has not been ignored by conventional engine designs, the potential effectiveness of this phenomenon has not been fully taken advantage of, at least partially due to the continued and consistent use of poppet valves for regulating the fluid flow into and out of the cylinders of an I.C. engine.

Therefore, the valve system of the present invention incorporates the use or one or more shutter valves as a means for providing a working fluid with a minimal amount of resistance as it travels along a predefined path of fluid flow and as it is delivered into the cylinder. More specifically, the shutter valve structure of the present invention preferably comprises what may be referred to as a "folding leaf" or "folding blade" valve which is electronically operated and computer controlled for accomplishing precise timing and positioning in order to adjustably vary the size of a central aperture formed within each shutter valve, when in an open position. A substantially unobstructed, free flow of fluid is thereby provided as the working fluid travels along its flow path and is delivered into the interior of a cylinder. Each shutter valve of the valve system of the present invention comprises a plurality of valve elements, which may be defined as "valve leaves" or "valve blades", movably or more specifically pivotally attached to a support frame or base and slidably positionable in at least partially overlapping relation to one another and which are collectively movable in substantially opposite directions to accomplish an opening or closing of the shutter valve structure. When in the open position, the central aperture is formed and the diameter and/or overall dimension of the central aperture may be adjustably varied so as to regulate fluid flow therethrough. The perimeter or circumference of the central aperture is defined by the correspondingly positioned peripheral edges of the valve elements which surround the central aperture and which are collectively oriented in a substantially circular or annular configuration or array. As set forth above, each cylinder comprises at least one intake valve and one spaced apart exhaust valve which are independently controlled by the aforementioned control assembly defined, at least in part by a central processing unit and a plurality of sensors which are disposed and structured to deliver sensor signals to the central processing unit indicative of predetermined, operating or performance characteristics of the I.C. engine.

Further, the valve system of the present invention may also include an activation assembly which may be in the form of an electronically regulated and powered drive motor interconnected, by any applicable means, to the plurality of valve elements. The drive motor regulates the timing and positioning of the plurality of valve elements by selectively orientating each of the shutter valves between an open position and a closed position and also determines the precise, variable adjustment of the size of the central aperture of each of the shutter valves.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENTS

Figure 1:
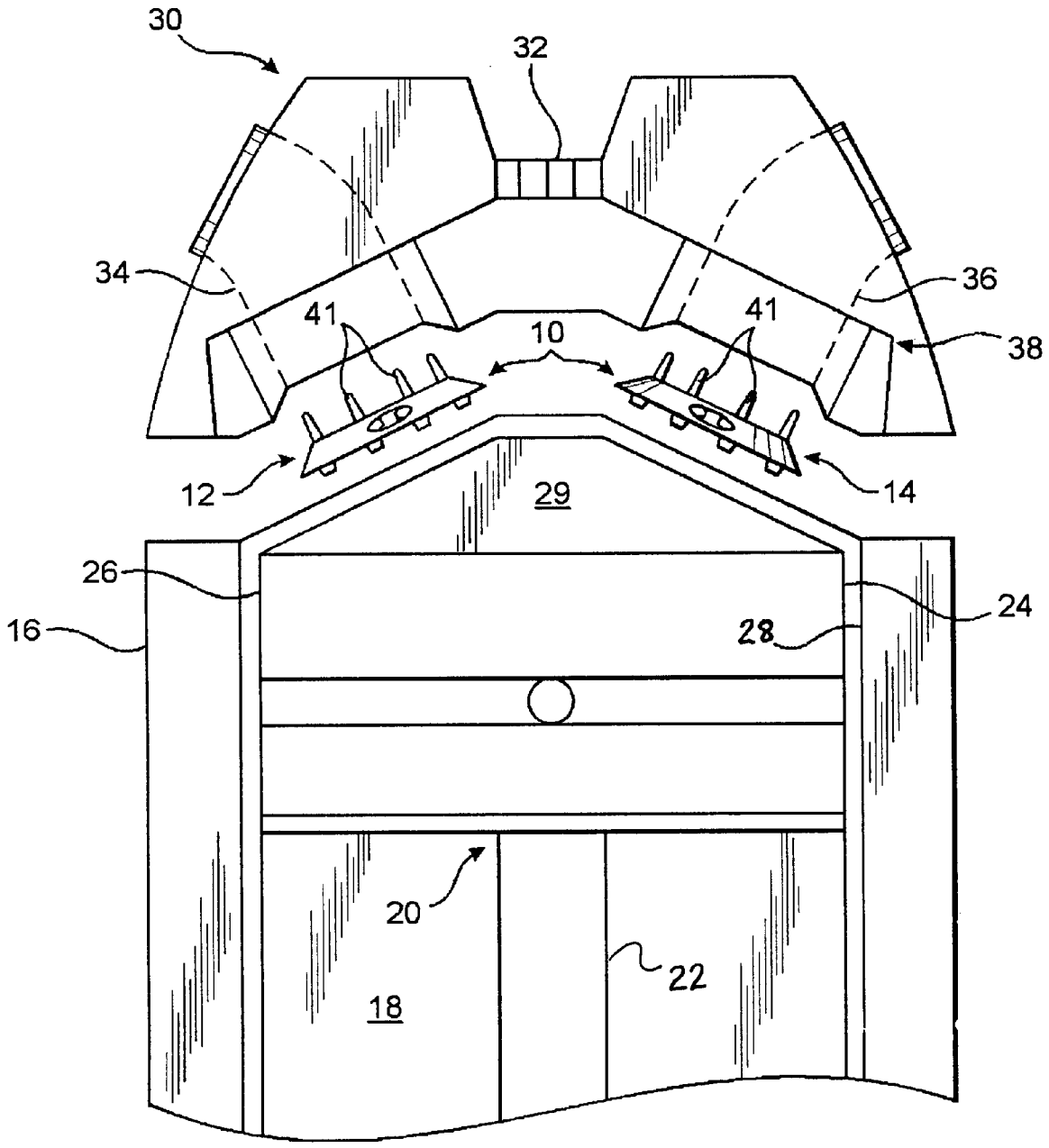
FIG. 1 is a side view in partially exploded form of a shutter valve system of the present invention associated with an internal combustion engine incorporating a cylinder and a reciprocating piston housed therein.
Figure 2:
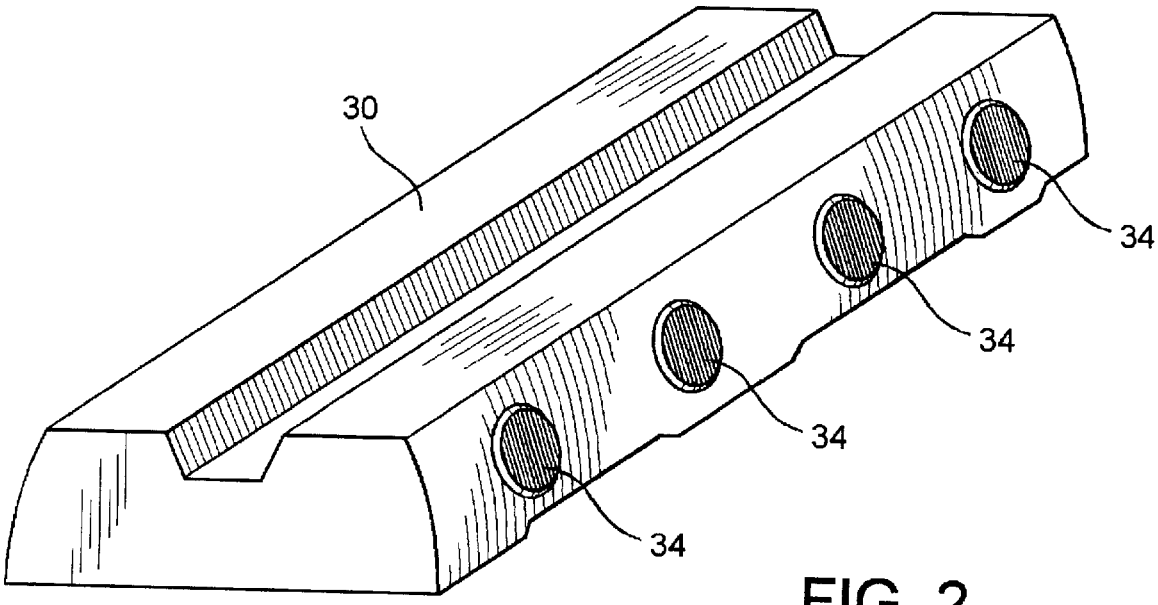
FIG. 2 is a perspective, top view of a cylinder head included in the embodiment of FIG. 1.

As shown in the accompany drawings, the present invention is directed towards a valve system incorporating at least one, but preferably, a plurality of "shutter" valves, each being indicated generally by reference numeral 10. With initial reference to FIG. 1, the valve system of the present invention comprises an intake valve 12 and an exhaust valve 14 designed to be incorporated within an internal combustion engine, wherein an engine block 16 houses one or more cylinders 18, in which a reciprocating piston, generally indicated by reference numeral 20 moves in a conventional, reciprocating fashion. Also, the piston 20 includes a piston rod 22 and a piston head 24, the perimeter 26 of which movably and sealingly engages the interior cylinder wall 28 through the provision of piston rings (not shown).

Figure 3:
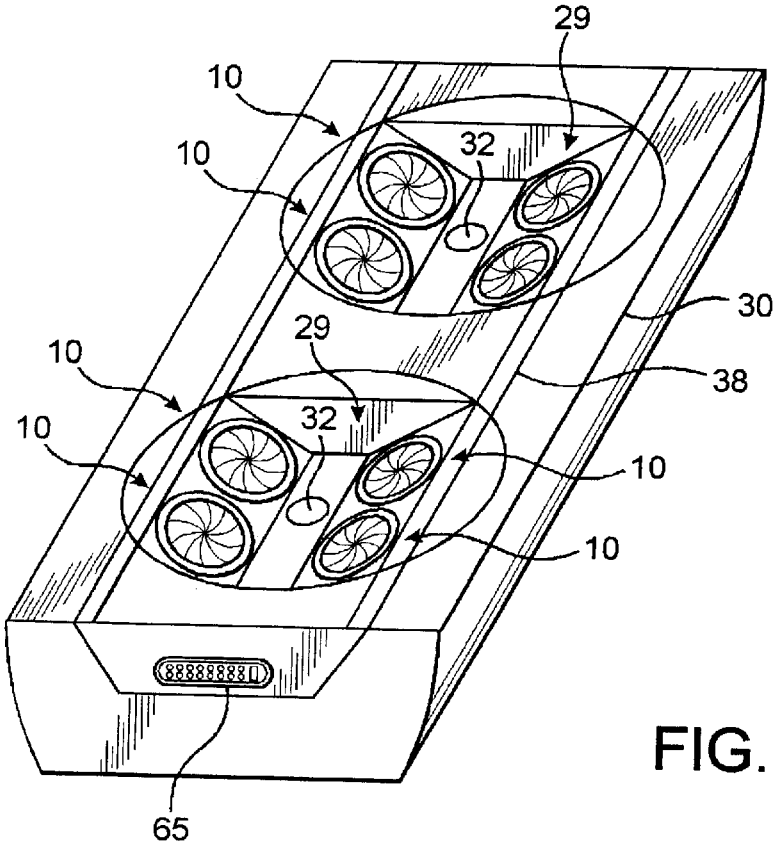
FIG. 3 is a perspective bottom view of the structure of FIG. 2.

As is conventional, the internal combustion ("I.C.") engine partially represented in FIG. 1 includes a cylinder head 30 having a socket 32 for the removable insertion of a spark plug or like structure which, when the various components of the I.C. engine are assembled, is disposed in direct communication with the interior of the combustion chamber 29. Further, the cylinder head includes an intake port 34 and an exhaust port 36 communicating with the intake manifold and exhaust manifold, respectively. The valve system of the present invention also includes a valve tray 38 shown in greater detail in FIGS. 3 and 4.

According to the present invention, each of the shutter valves, including the intake shutter valve 12 and the exhaust shutter valve 14 are preferably disposed in direct communication with the combustion chamber 29, as well as the remaining interior of the cylinder 18. Further, the shutter valves 12 and 14 are respectively disposed in fluid communication with the intake port 34 and the exhaust port 36 associated with the cylinder head 30. A plurality of bolts or like connectors 41 are provided to accomplish a fluid-tight mounting or attachment of each of the shutter valves 12 and 14 between the respective intake and outlet ports 34 and 36 and the interior of the combustion chamber 29. Gaskets or other sealing structures may also be utilized to accomplish the fluid tight seal, if required.

Figure 4:
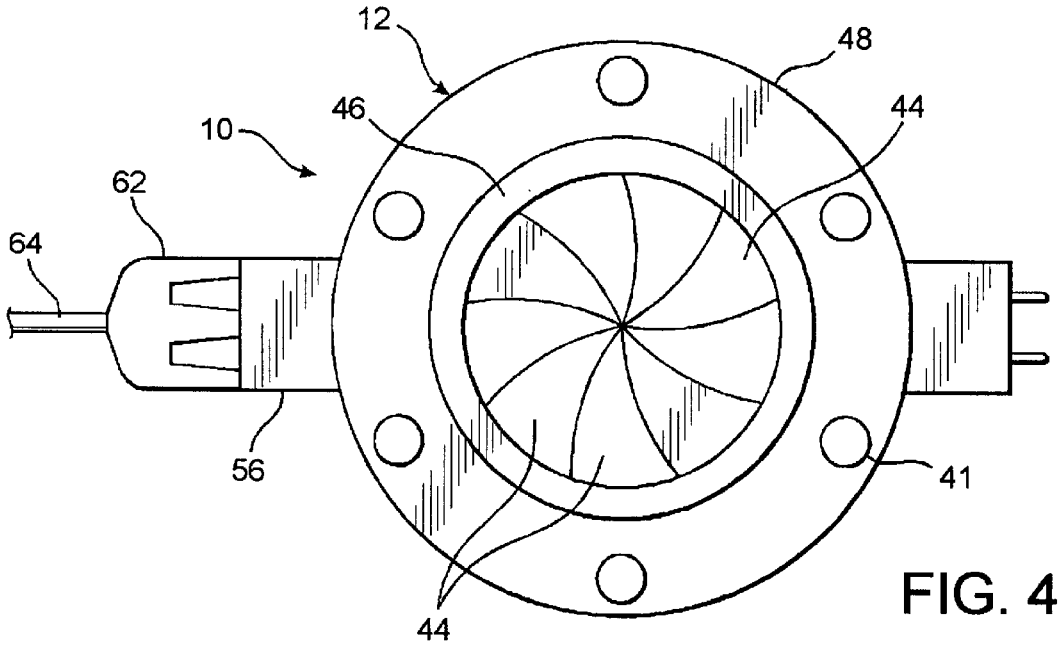
FIG. 4 is a detailed view of a portion of a shutter valve structure associated with the embodiments of FIGS. 1–3.
Figure 5:
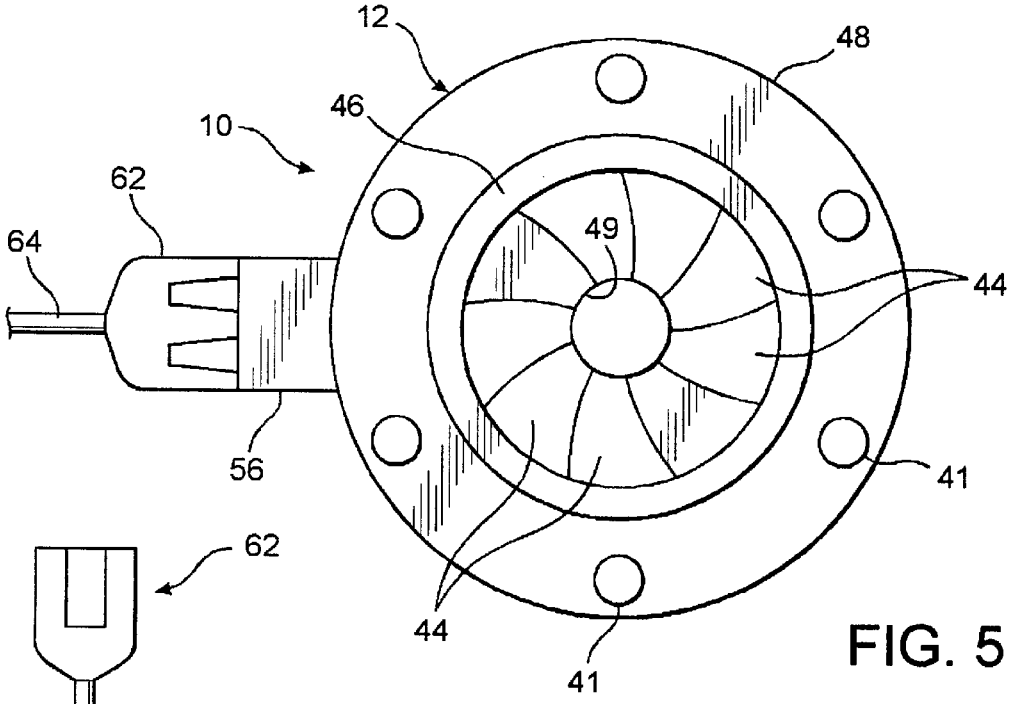
FIG. 5 is a detailed view of the structure of the valve of FIG. 4 shown in an open position.

With reference now to FIGS. 4 and 5, each of the aforementioned shutter valves comprises a plurality of valve elements 44 which are movably connected, but more preferably pivotally connected, to a mount or connecting structure 46 which interconnects and movably attaches each of the valve elements 44 to a support base or frame 48. The aforementioned bolts 41 or like mounting connectors such as a pin, pass at least partially through the base 48 and serve to properly mount each of the shutter valves 12, 14 in sealed, fluid-tight and communicating relation between the respective intake and exhaust ports 34 and 36 and the combustion chamber 29. Each of the shutter valves 10, represented in FIGS. 4 and 5 by the intake shutter valve 12, may be more precisely defined as a "folding leaf" or "folding blade" shutter valve in that the plurality of valve elements 44 are preferably, but not necessarily, defined by a plurality of substantially, equally sized leaves or blades pivotally attached and/or interconnected to the support base 48.

In addition, the valve elements 44 are slidingly movable relative to one another, and arranged in at least partially overlapping relation, as shown in both FIGS. 4 and 5. FIG. 4 illustrates the intake shutter valve 12 in a closed position, whereas FIG. 5 represents the intake shutter valve 12 in an open position. The open position is defined in each of the shutter valves 10 by a central aperture 49 which has a variable and adjustable diameter and overall dimension. The central aperture 49 therefore defines at least a portion of a flow path of a working fluid, such as an air/fuel mixture or the exhaust gases, passing into and out of the interior of the cylinder 18 in direct fluid communication with the combustion chamber 29. The diameter and/or overall dimension of the central aperture 49 is variable by causing relative movement of the plurality of valve elements 44 in sliding relation to one another, wherein the plurality of valve elements 44 of each shutter valve 10 collectively surround the central aperture 49, and thereby, define its size as the valve elements 44 move between the closed position of FIG. 4 and the open, operative position of FIG. 5. As clearly shown in FIG. 5, the corresponding peripheral edges of the plurality of valve elements 44 define the periphery of the central aperture 49, which in turn, at least partially regulates the flow of working fluid along the flow path, into and out of the interior of the cylinder 18 and in particular, the combustion chamber 29. As is readily apparent, the central aperture 49 includes no obstructions therein, and therefore, further defines that portion of the aforementioned flow path of the working fluid to be "free flowing" and/or substantially unobstructed. In actual practice and during operation, a preferred dimension of the central aperture 49 is such that the circumference thereof is maintained slightly or at least minimally larger than the circumference of the jet stream of working fluid passing therethrough. As shown in FIG. 4, the plurality of valve elements 44 are arranged such that the central aperture 49 is completely closed and "sealed" to prevent escape of gases beyond the circular or annular array of the overlapping valve elements 44.

Figure 6:
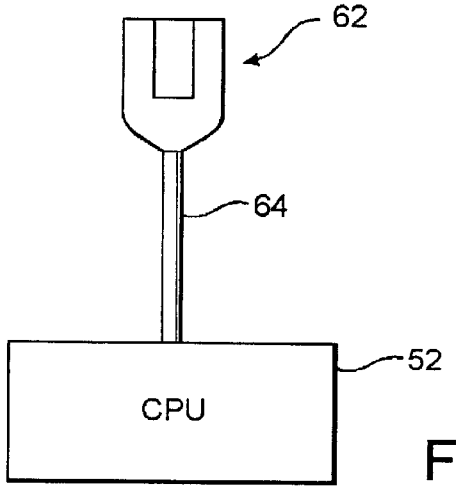
FIG. 6 is a schematic representation of a portion of a control assembly of the valve system of the present invention.
Figure 7:
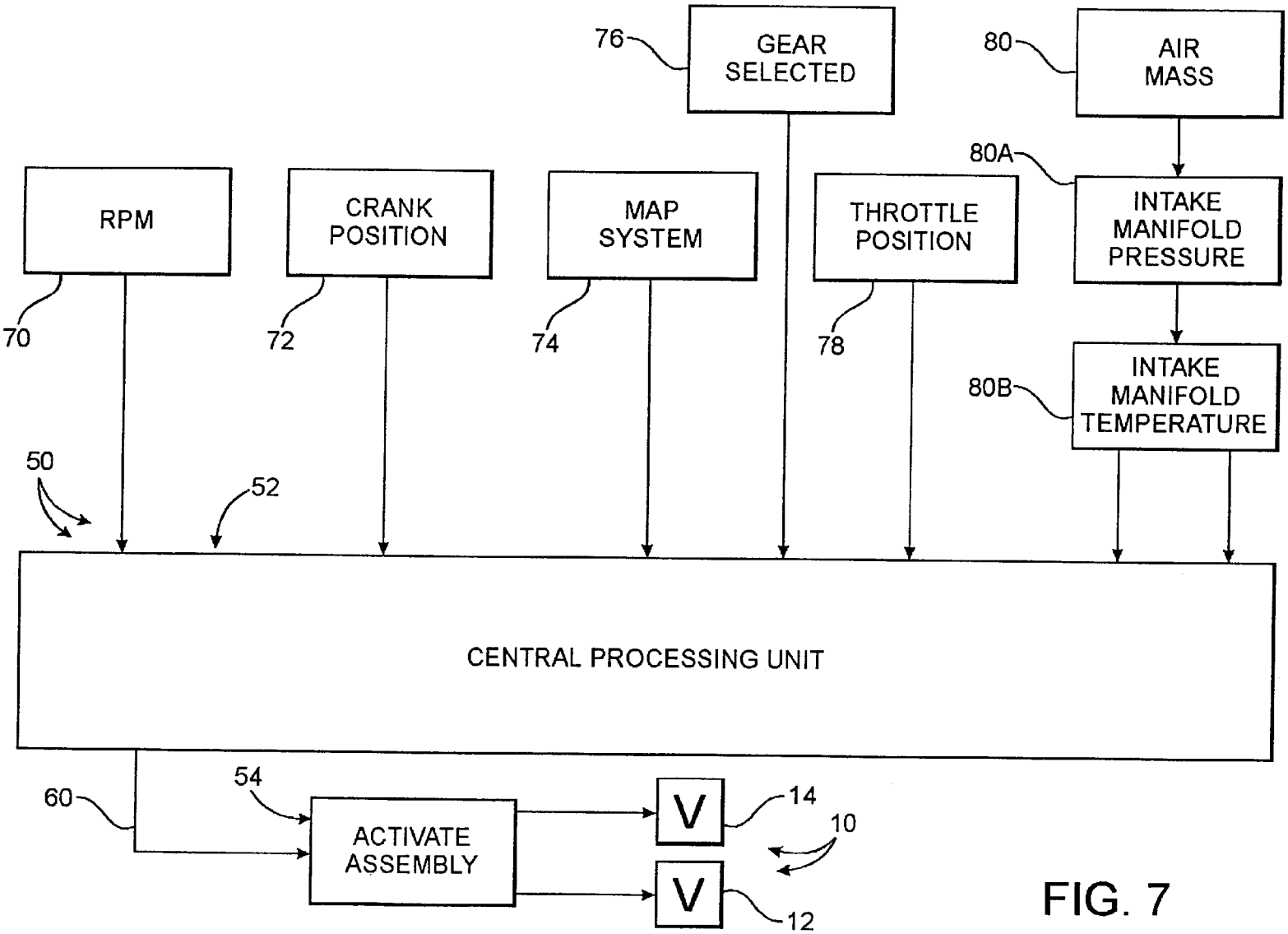
FIG. 7 is a schematic view in block diagram form of an additional part of the control assembly associated with the valve system of the present invention.

With reference to FIGS. 4–7, a preferred embodiment of the present invention further includes a control assembly, generally indicated as 50. The control assembly 50 comprises a computer microchip and/or a central processing unit (CPU) 52 and a plurality of sensors operably connected to and/or linked to the CPU. The sensors, which may vary in number, design, structure and disposition, are mounted or structurally included within the internal combustion engine itself and/or the vehicle in which it is mounted. The sensors are structured and disposed to continuously monitor a plurality of predetermined operating and performance characteristics of the I.C. engine and/or vehicle during the operation thereof. With reference to FIG. 7, examples of such operating and performance characteristics may include engine speed or revolutions per minute (RPMs), indicated by reference numeral 70, crankshaft position 72, gear selection 76, throttle position 78, and air mass sensor 80, which in turn, is derived from the intake manifold pressure 80A and intake manifold temperature 80B. Each of the sensors 70, 72, 76, 78, 80, 80A and 80B are structured to generate sensor signals and transmit such signals back to the central processing unit 52. In addition to the above, FIG. 7 shows the inclusion of a MAP system 74 responsive to the central processing unit 52 which of course is to be considered a part of the control assembly 50. The structure and operational characteristics of a MAP system will clearly fall within the purview of those skilled in the art of the structure and operation of internal combustion engines. Accordingly, the "MAP" is a part of the information programmed into the computer or central processing unit 52 which is used, in the present invention to determine the valve timing, in terms of opening and closing as well as the precise dimensioning of the central aperture 49 of the shutter valve 12 and 14 associated with the intake and outlet ports 34 and 36, respectively, as well as the interior of the combustion chamber 29. More specifically, the term "MAP" refers to pre-programmed two or three dimensional graphs which describe, by way of example, fuel flow to the engine for a given operating range of RPMs at which the engine is operating. The number of graphs programmed into the MAP system may range in the thousands. Accordingly, the shutter valve system of the present invention would be programmed with similar MAPs, of the type well recognized by those skilled in the structure and operation of internal combustion engines but would also take into account that the system is controlling the entire intake process of the engine rather than just the flow of fuel to the combustion chamber. The MAP system therefore is one of the plurality of data sources on which the central processing unit 52 relies, in addition to the input from the remaining sensors 70, 72 and 76 through 80. In turn, the central processing unit 52 is structured to generate one or more activating signals to at least one activating assembly, generally indicated as 54. The activating assembly 54 may include an electronically powered and controlled drive motor 56, shown in FIGS. 4 and 5, disposed in interconnecting, driving relation to the plurality of valve elements 44 so as to regulate the positioning and movement thereof relative to one another. The timing of the opening and closing of the individual shutter valves 10 and the size of the central aperture 50 are regulated by controlling the movement and positioning of the individual valve elements 44 relative to one another. The driving interconnection between the drive motor 56 and the valve elements 44 may include any one of a variety of mechanical gear structures or electro-mechanical linking and/or gearing structures.

The control assembly, 50, and more in particular, the CPU 52, is specifically structured and includes suitable programming to process each of the sensor signals generated and transmitted by the plurality of sensors 70–80B to the CPU, as set forth above. Dependent on the collective and/or individual operating and performance characteristics determined by the sensor signals, the CPU 52 will deliver, preferably on a continuous basis, a plurality of activating signals 60, to the activating assembly 54. In response to the activating signals 60 received, the activating assembly 54, is structured to and will then regulate the timing and positioning of the individual drive motors 56 of shutter valves 12 and 14, by the positioning of the valve elements 44 through activation of the respective drive motors 56. As shown in FIGS. 4, 5 and 6, appropriate connector plugs 62 or other suitable connecting structures are interconnected to the various components, such as the CPU 52 and the individual drive motors 56 of shutter valves 10 by means of appropriate electrical conductors or cables, as at 64. Receiving sockets or plugs 65 are appropriately designed and disposed to receive connector plugs 56.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is maimed is:

1. A valve system designed for regulating fluid flow into ant out of a cylinder of an internal combustion engine, said valve system comprising:

a) a valve assembly including at least an intake valve and an exhaust valve each disposed in fluid communicating relation to the cylinder, b) at least one of said intake or exhaust valves comprising a shutter valve including a centrally disposed aperture of adjustable dimension, c) an activating assembly connected to said valve assembly and structured to position said shutter valve between an open position and a closed position, and d) a control assembly connected in regulating relation to said activating assembly and structured to determine positioning of said shutter valve dependent on operating characteristics of the internal combustion engine.

2. A valve system as recited in claim 1 wherein said shutter valve comprises a base, a plurality of valve elements movably mounted on said base in sliding, at least partially overlapping relation to one another, said plurality of valve elements disposed in a substantially annular array and collectively surrounding said central aperture when said shutter valve is disposed in said open position.

3. A valve system as recited in claim 2 wherein said central opening at least partially defines a path of fluid flow communicating with the cylinder; said activating assembly and said control assembly cooperatively structured to regulate the dimension of said central aperture and relative movement of said plurality of valve elements.

4. A valve system as recited in claim 2 wherein said plurality of valve elements are defined by a plurality of folding blades each pivotally mounted on said base in at least partially overlapping relation to one another and in collectively surrounding relation to said central aperture and a flow of fluid passing therethrough.

5. A valve system as recited in claim 1 wherein said control assembly comprises a central processing unit connected in regulating relation to said activating assembly and structured to control positioning of said shutter valve between said open and closed positions.

6. A valve system as recited in claim 5 wherein said control assembly further comprises a plurality of sensor structures each connected to the internal combustion engine and structured to collectively generate a plurality of sensor signals indicative of predetermined operating characteristics of the internal combustion engine.

7. A valve system as recited in claim 6 wherein said central processing unit is responsive to said plurality of sensor signals and structured to generate activating signals to said activating assembly to selectively regulate positioning of said shutter valve dependent on indicated operating characteristics of the internal combustion engine.

8. A valve system as recited in claim 7 wherein said shutter valve comprises a base, a plurality of valve blades movably mounted on said base in sliding, at least partially overlapping relation to one another, said plurality of valve blades disposed in a substantially annular array and collectively surrounding said central aperture when said shutter valve is disposed in said open position.

9. A valve system as recited in claim 8 wherein said activating assembly comprises an electrically powered drive motor drivingly interconnected to said shutter valve and structured to concurrently position said plurality of valve blades between said open and closed positions.

10. A valve system as recited in claim 9 wherein said shutter valve defines said intake valve.

11. A valve system as recited in claim 10 wherein said central aperture at least partially defines a path of fluid flow to the cylinder; said activating assembly and said control assembly cooperatively structured to regulate the size of said central aperture and relative movement of said plurality of valve blades.

12. A valve system as recited in claim 1 wherein each of said intake and exhaust valves comprises a shutter valve.

13. A valve system as recited in claim 12 wherein each of said shutter valves comprises a base, a plurality of valve elements movably mounted on said base in sliding, at least partially overlapping relation to one another, said plurality of valve elements disposed in a substantially annular array and collectively surrounding a central aperture when said shutter valve is disposed in said open position.

14. A valve system designed to regulate fluid flow between a cylinder and intake and exhaust ports of an internal combustion engine, said valve system comprising:

a) a valve assembly including an intake valve and an exhaust valve disposed in fluid regulating relation between the cylinder and the intake and exhaust ports respectively, b) each of said intake and exhaust valves comprising a shutter valve, c) each of said shutter valves comprising a plurality of at least partially overlapping valve elements pivotally mounted in slidable relation to one another and collectively disposable between an open position and a closed position, and d) said open position of each shutter valve comprising a single, central aperture of adjustable dimension disposed to define a substantially unobstructed path of fluid flow between the cylinder and corresponding ones of the intake and exhaust manifold.

15. A valve system as recited in claim 14 wherein said plurality of valve elements of each of said shutter valves are disposed exteriorly of the cylinder when in said open and closed positions.

16. A valve system as recited in claim 15 wherein each of said shutter valves comprises a base connected in supporting relation to said plurality of valve elements, said plurality of valve elements pivotally connected to said base in collectively surrounding relation to said central opening and concurrently movable in a substantially annular array to regulate the dimension of said central aperture and a path of fluid flow therethrough.

17. A valve system as recited in claim 16 further comprising a control assembly including a central processing unit interconnected in regulating relation to said valve assembly and responsive to operating characteristics of the internal combustion engine to regulate positioning of each of said shutter valves.

18. A valve system as recited in claim 17 wherein said control assembly comprises a plurality of sensor structures each connected to the internal combustion engine and structured to collectively generate a plurality of sensor signal indicative of predetermined operating characteristics of the internal combustion engine.

19. A valve system as recited in claim 18 further comprising an activating assembly interconnected between said control assembly and said valve assembly and in driving relation to each of said shutter valves independently of one another.

20. A valve system as recited in claim 19 wherein said central processing unit is responsive to said plurality of sensor signals and structured to generate activating signals to said activating assembly to selectively regulate independent positioning of each of said shutter valves dependent on indicated operating characteristics of the internal combustion engine.

* * * * *